US007100229B2

(12) United States Patent
O'Reagan

(10) Patent No.: US 7,100,229 B2
(45) **Date of Patent: *Sep. 5, 2006**

(54) SHEAR REDUCING MATTRESS SYSTEM

(75) Inventor: James R. O'Reagan, Greer, SC (US)

(73) Assignee: Span-America Medical Systems, Inc., Greenville, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/929,187

(22) Filed: Aug. 30, 2004

(65) Prior Publication Data

US 2005/0044635 A1 Mar. 3, 2005

Related U.S. Application Data

(60) Provisional application No. 60/498,527, filed on Aug. 28, 2003.

(51) Int. Cl.
*A47C 27/14* (2006.01)

(52) U.S. Cl. ..... 5/736; 5/731; 5/944

(58) Field of Classification Search ..... 5/727, 5/730, 713, 736, 740, 655.9, 944, 953, 731
See application file for complete search history.

(56) References Cited

U.S. PATENT DOCUMENTS

| | | | | |
|---|---|---|---|---|
| 3,885,258 | A | 5/1975 | Regan | |
| D246,816 | S | 1/1978 | Tam et al. | |
| 4,383,342 | A * | 5/1983 | Forster | 5/731 |
| 4,665,573 | A | 5/1987 | Fiore | |
| 4,862,538 | A * | 9/1989 | Spann et al. | 5/730 |
| 4,901,387 | A * | 2/1990 | Luke | 5/730 |
| 4,955,096 | A | 9/1990 | Gilroy et al. | |
| 4,967,433 | A * | 11/1990 | Neal | 5/655.9 |
| 5,007,124 | A * | 4/1991 | Raburn et al. | 5/731 |
| 5,025,519 | A * | 6/1991 | Spann et al. | 5/730 |
| 5,088,136 | A * | 2/1992 | Stryker et al. | 5/81.1 R |
| 5,252,278 | A * | 10/1993 | Spann et al. | 264/138 |

(Continued)

FOREIGN PATENT DOCUMENTS

| | | | |
|---|---|---|---|
| GB | 2197785 | A * | 6/1988 |
| GB | 2274054 | | 7/1994 |

*Primary Examiner*—Robert G. Santos
(74) *Attorney, Agent, or Firm*—Dority & Manning

(57) ABSTRACT

A foam mattress system having transverse support ribs is provided for reduction of shear stress between a person's skin and the surface of the mattress system. The mattress system may include a mattress to be used independent of other mattresses or springs, or a mattress pad to be used atop other mattresses or springs, and either may be used on both a flat bed and a bed with an inclined torso section. The mattress system includes transverse, lateral support ribs upon the support surface of the mattress. The support ribs have a predetermined cross-sectional geometry that is curvilinear with a superior aspect generally disposed for receipt of a person and a smaller inferior aspect opposite. The inferior aspect of the cross-section of the support ribs may undercut the portion of the support ribs vertically above it. Having such cross-sectional geometry, the support ribs are thereby directionally oriented, either toward the foot or toward the head of the mattress system. The mattress system may include support ribs that are directionally oriented toward the foot of the bed in regions adapted for the person's upper torso, buttocks, and lower legs, and directionally oriented toward the head of the bed in a region adapted for the person's thighs. The mattress system may also include longitudinal cuts in the support surface, perpendicular to the transverse support ribs, thereby defining independent support cells upon the support surface.

27 Claims, 10 Drawing Sheets

U.S. PATENT DOCUMENTS

D367,390 S 2/1996 Johnston et al.
D367,391 S 2/1996 Johnston et al.
D371,035 S 6/1996 Davis
5,533,218 A 7/1996 Fahy
5,580,504 A * 12/1996 Spann et al. ..... 264/138
5,671,492 A 9/1997 Simon
D433,861 S * 11/2000 Rose et al. ..... D6/596
6,256,822 B1 * 7/2001 Weston et al. ..... 5/732
6,334,442 B1 * 1/2002 Altamura ..... 128/845
6,381,784 B1 5/2002 Davis et al.
6,704,961 B1 * 3/2004 Kienlein ..... 5/730
D502,350 S * 3/2005 O'Reagan ..... D6/596
2005/0044635 A1 * 3/2005 O'Reagan ..... 5/736
2005/0076448 A1 * 4/2005 O'Reagan ..... 5/736

* cited by examiner

SHEAR REDUCING MATTRESS SYSTEM

CROSS-REFERENCE TO RELATED APPLICATIONS

This application claims benefit of U.S. Provisional Application No. 60/498,527, filed Aug. 28, 2003.

BACKGROUND OF THE INVENTION

This invention concerns a mattress system, including either a mattress or a mattress overlay with support surface features for reducing shear stress to the skin of a person received thereon.

In medical care, the prevention of decubitus ulcers to the skin of non-ambulatory persons remains a goal. Also known as "bed sores" and "pressure ulcers," decubitus ulcers may result in part from physiological causes such as decreased circulation, reduced skin integrity, impaired nutrition, and other bodily weaknesses. Certain areas of the body have been observed to have a relatively greater tendency to develop decubitus ulcers, including the spine, hips, buttocks, elbows, and heels. Conversely, certain portions of the body have been observed to have a relatively lesser tendency for the development of decubitus ulcers, such as the thigh area in which greater blood flow, the absence of bony prominences, and larger weight-bearing surfaces may be found.

In addition to physiological causes, external factors may contribute to the development of decubitus ulcers. Localized pressure to the skin is one such factor. Pressure to the skin occurs from support by the mattress system of the person's weight. Because different portions of the human body have different weights and have different surface areas for distribution of that weight upon a mattress, different pressure can be brought to bear at various locations along a person's body, with localized points of relatively great pressure. Of course, a generally planar mattress surface, supporting the very non-planar human body, will result in even smaller areas of support, with concomitant greater increase in the pressure upon those areas.

Another external cause that may exacerbate the development of decubitus ulcers is moisture from perspiration, which makes the skin softer and more tender. As a person lies on a bed, perspiration from skin in contact with the bedding surface may tend to accumulate rather than fully evaporate. By remaining in contact with the skin, the perspiration softens the skin and makes it more susceptible to breakdown, and thereby more susceptible to decubitus ulcers.

Still a third external exacerbation of the tendency of decubitus ulcer development is shear stress upon the skin. Shear stress occurs, in part, from the friction of rubbing the surface of the skin. For the bed-bound person, shear most often occurs specifically between the person's skin and the bed linens upon the mattress. However, the degree and extent of that shear stress is influenced by the surface features of the mattress or padding beneath the bed linens. For example, a button sewn to the fabric surface of a conventional mattress may not itself come in direct contact with the skin of a person lying upon the mattress if the mattress is covered with a sheet. However, that button may greatly increase the shear upon the skin of a person moving upon the sheets over the button, as it is an irregularity that would be felt through the sheets. Some shear stress to the skin of a person reclined upon a bed may be unavoidable, as some movement upon bedding is natural and in fact often is medically preferred. However, the presence of unnecessary irregularities projecting even slightly from the surface of a mattress may needlessly increase the opportunity for and the degree of unwarranted and damaging shear stress to the skin.

The problem of shear stress to a person's skin is further complicated by the fact that nonambulatory persons may benefit from having the head portion of their bed system raised. A raised head portion may improve blood flow and digestion, may promote beneficial social discourse with and entertainment of the bed-bound person, and facilitates eating and the oral administration of drugs. However, the raising of the head of the bed also results in gravitationally-generated shear stress upon the skin of the person, as the person's body is forced downward along the inclined slope of the mattress surface, generating shear stress against the mattress surface.

To combat the development of decubitus ulcers, the medical practice has employed the use of foam mattresses, or foam overlays upon conventional mattresses, for non-ambulatory persons and others at risk of such problems. Such foam products often include cuts or slices upon their surface so as to more greatly disperse localized pressure upon areas of the body, and also to better allow for ventilation of collected perspiration for drying of the skin. However, while addressing pressure and moisture as contributors to the development of decubitus ulcers, such products have not optimally reduced shear upon the skin as another contributor, and particularly have not addressed the increase in shear stress caused by elevation of the head of the bed.

SUMMARY

In response to the discussed difficulties and problems, a new shear reducing mattress system has been discovered.

The present invention includes generally a mattress or mattress overlay of resilient material containing a plurality of directionally oriented support ribs transverse to the longitudinal length of the mattress or pad. Such support ribs have a predetermined cross-sectional geometry that is curvilinear. Because the cross-sectional geometry is curvilinear, the support ribs contain no lines formed by the intersection of two planes and therefore contain no protuberance that would tend to increase shear stress to the skin of a person upon the mattress system. Further, the centerline of the cross-section of each support rib is inclined at an acute angle relative to the general plane of the bed, providing a directional orientation to each support rib that is transverse to the support rib and lengthwise along the mattress or mattress overlay. According to this geometry, the cross-section of each support rib includes a superior aspect that is disposed generally for receipt of a person upon the mattress system. Additionally, this geometry likewise includes an opposite inferior aspect to the geometry of each support rib. The superior aspect and the inferior aspect meet generally at the center line of the geometry of the cross-section of a support rib and together constitute the entirety of the cross-section of a support rib. The inferior aspect of the cross-sectional geometry may also undercut the superior aspect relative to the vertical dimension of the mattress or mattress overlay. A support rib so configured may be biased to more readily compress or collapse toward the undercutment. As such, shear stress will tend to be lessened for movement by a person in the direction of the directional orientation of the support ribs.

A mattress or mattress pad including such directional support ribs may be configured to include different zones of such directional support ribs along its longitudinal length. Such different zones may be created by fabricating the mattress with directional support ribs at certain locations along the length of the mattress that are directionally oriented toward the foot of the bed, and oppositely at other locations. The directional orientation of the support ribs for those locations expected to receive and support a person's head and upper torso may be directed toward the foot of the bed, while the directional orientation of the support ribs adapted for support of a person's thighs may be directed toward the head of the bed. In such a configuration, shear forces upon the skin of a person upon such a product with the head of the bed elevated would be reduced for the head, upper torso, and ischial tuberosities, while at the same time additional support and resistance to sliding would be provided for that portion of the person's weight borne by the person's thighs at which the tendency for the development of decubitus ulcers is physiologically less. In addition, or alternatively, such different zones may be created by varying the respective geometries of the superior aspects and inferior aspects of the cross-sections of different support ribs at different locations along the longitudinal length of the mattress or mattress overlay, thereby changing the dimensions of the channels between adjacent support ribs, so as to provide systematized reduction in shear forces for those areas of the person's body more susceptible to the development of decubitus ulcers.

The present invention may comprise an upper support surface for which the uppermost portions of the support ribs reside in a single plane. Alternatively, a plurality of such planes may be configured. In one embodiment, the portion of the support surface adapted for receipt of the head and upper torso may define one plane, the portion adapted for receipt of the gluteal region may comprise another plane not parallel to the first plane, the location adapted for receipt of the person's thighs may define a third plane, and the portion adapted for receipt of the person's calves and feet may define yet a fourth plane. So configured, the mattress or mattress pad may further provide for better management and reduction of shear forces, especially if the head of the bed is elevated as described above.

The present invention may also include longitudinal cuts or slices along the length of the mattress or mattress overlay. Such longitudinal cuts, intersecting the support ribs, create cells upon the surface of the mattress or mattress overlay. Such cells, in effect providing smaller "mini-mattresses," may provide for pressure dispersion and, in cooperation with the geometry of the support ribs, may result in further shear reduction. Such longitudinal cuts may be equally spaced apart, or may have differential spacing as may be advantageous in given situations.

Additional objects and advantages of the inventions will be set forth in part in the following description, or may be obvious from the description, or may be learned from practice of the invention.

BRIEF DESCRIPTION OF THE DRAWINGS

The aspects described above, as well as other apparent aspects, advantages, and objectives of the present invention are apparent from the detailed description below in combination with the drawings in which.

DETAILED DESCRIPTION

Figure 1:
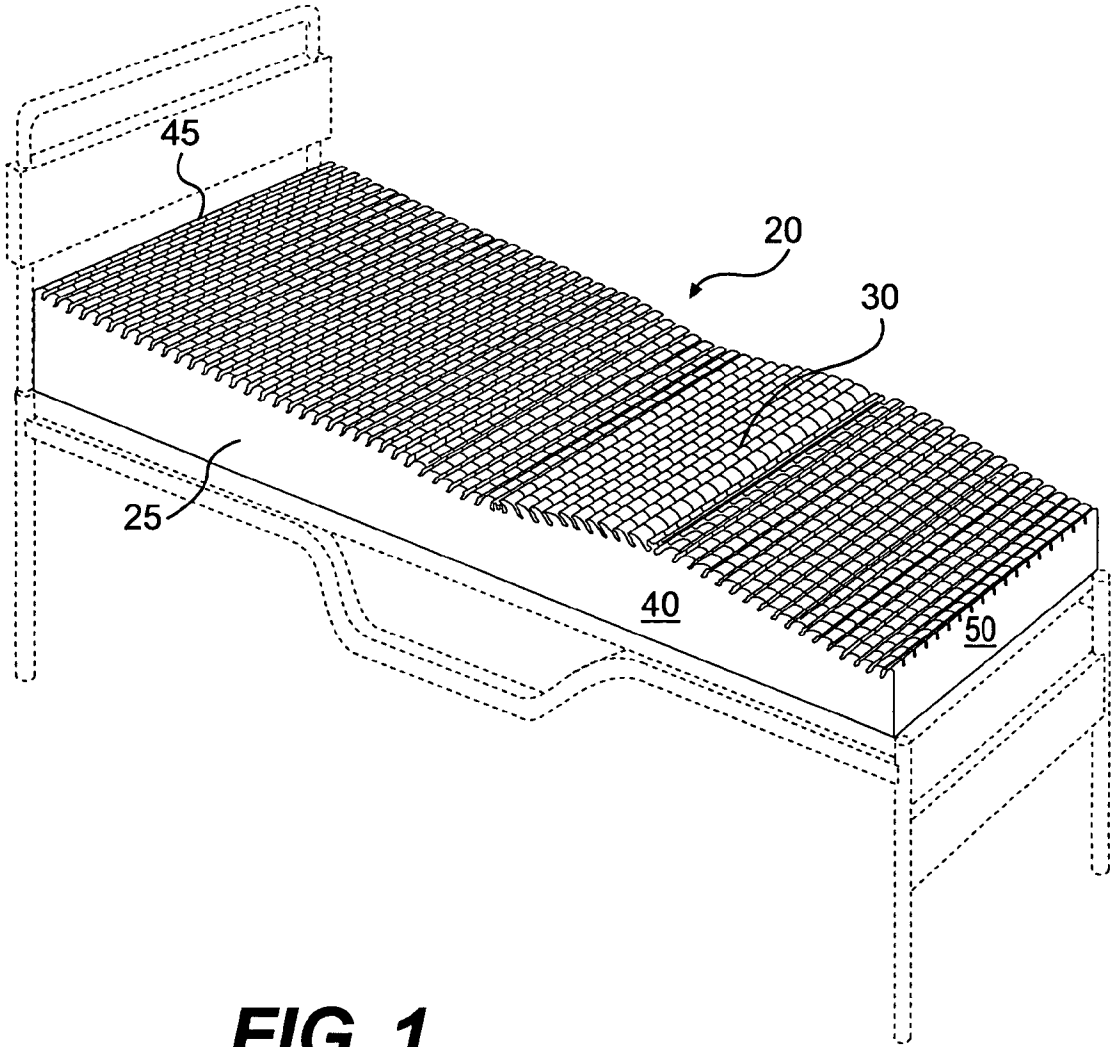
FIG. 1 is a perspective view of an exemplary mattress constructed according to the present invention.

Reference will now be made in detail to the presently preferred embodiments to the invention, one or more examples of which are illustrated in the drawings. Each example is provided by way of explanation of the invention, and not meant as a limitation of the invention. For example, features illustrated or described as part of one embodiment may be used on another embodiment to yield a still further embodiment. It is intended that the present application includes such modifications and variations as come within the scope and spirit of the invention. The same numerals are used to refer to the same features throughout the drawings and in the text that follows.

Figure 2:
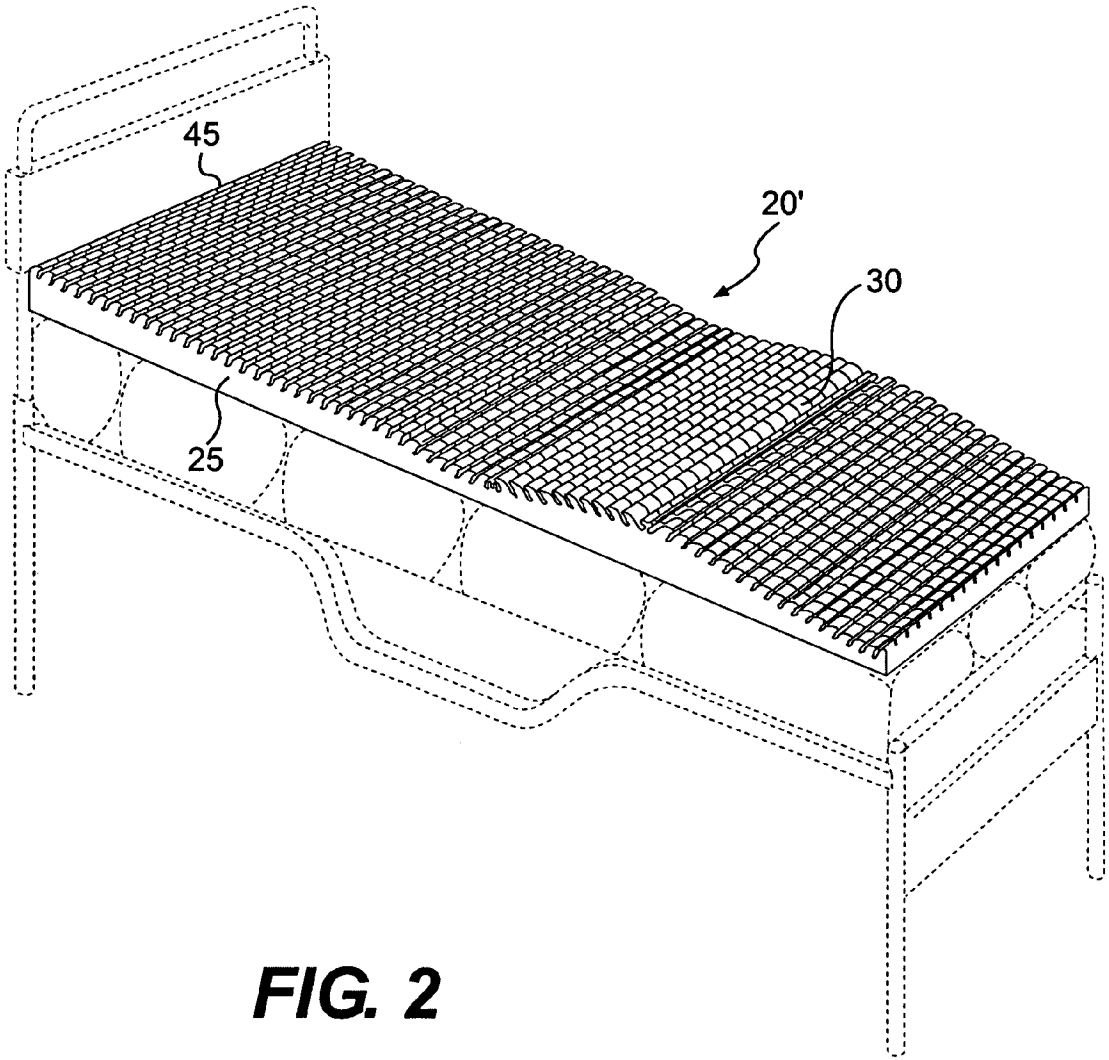
FIG. 2 is a perspective view of an exemplary mattress overlay for use upon a conventional mattress, constructed according to the present invention.

Referring to the Figures, a mattress generally 20 includes a main body 25 comprised of a resilient material, for example polyurethane foam. The mattress 20 is generally rectangular. As shown in FIG. 1, the mattress 20 may be configured of a greater predetermined thickness to constitute the entirety of a mattress system upon a bed. Alternatively, as shown in FIG. 2, the mattress generally 20' may be configured of a lesser predetermined thickness so as to be used as a mattress overlay upon a conventional mattress system on a bed. As described herein, a "mattress" may be understood to be of any predetermined thickness, including a mattress overlay or pad for use alone or in combination with other cushioning devices, or a mattress of greater predetermined thickness for use independent of other cushioning devices.

The mattress 20 defines a upper support surface generally 30 for receipt of a person reclined thereon. The mattress 20 may be understood to have a longitudinal orientation from the head 45 of the mattress 20 to the foot 50. The mattress 20 may also be understood to have a lateral orientation from side to side.

Figure 3:
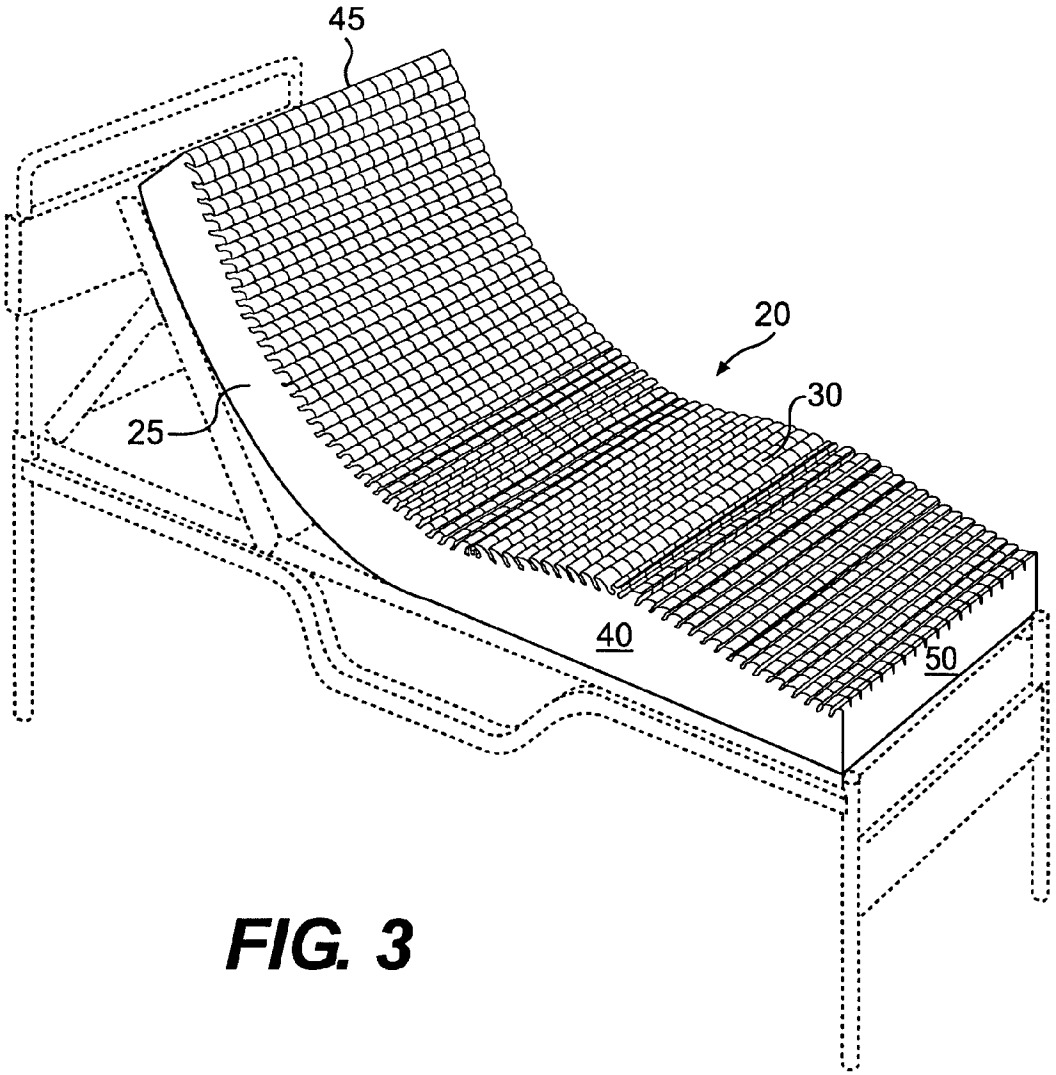
FIG. 3 is a perspective view of a mattress constructed according to the present invention, with the head section raised.

The upper support surface 30 of the mattress 20 includes a plurality of directional support ribs 65. The directional support ribs 65 extend laterally. The directional support ribs 65 may be disposed along the entire longitudinal length of the mattress 20, or instead may be disposed only in preselected areas along such length. As shown in FIGS. 1 and 2, the mattress 20 may be used upon a flat bed system. Alternatively, and as illustrated in FIG. 3, the mattress 20 may be used with a bed system capable of elevating the head of the bed for advantageous medical reasons. Additionally, a mattress overlay or pad, such as shown in FIG. 2, may likewise be used upon a bed in the elevated head position (not shown).

Figure 4:
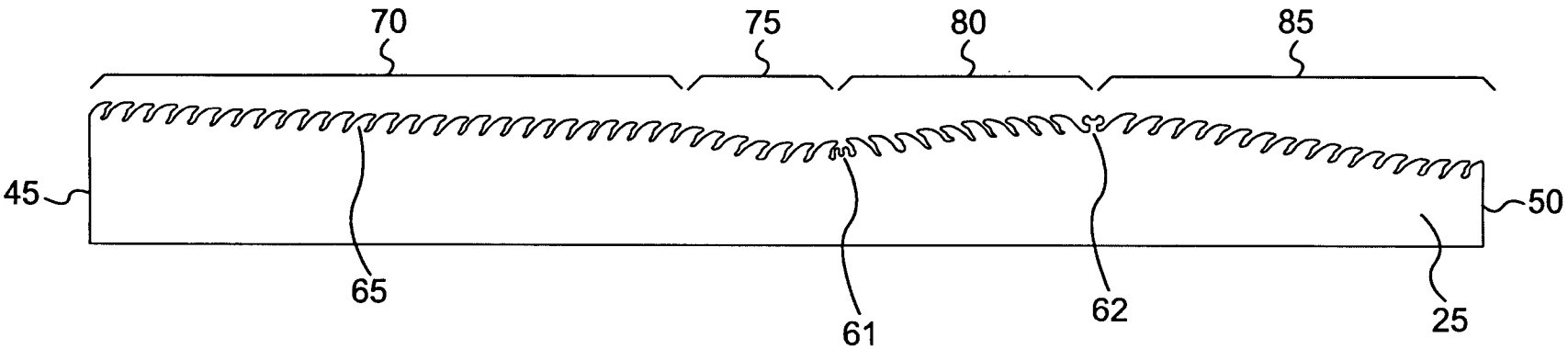
FIG. 4 is a side view of a mattress constructed according to the present invention.
Figure 5:
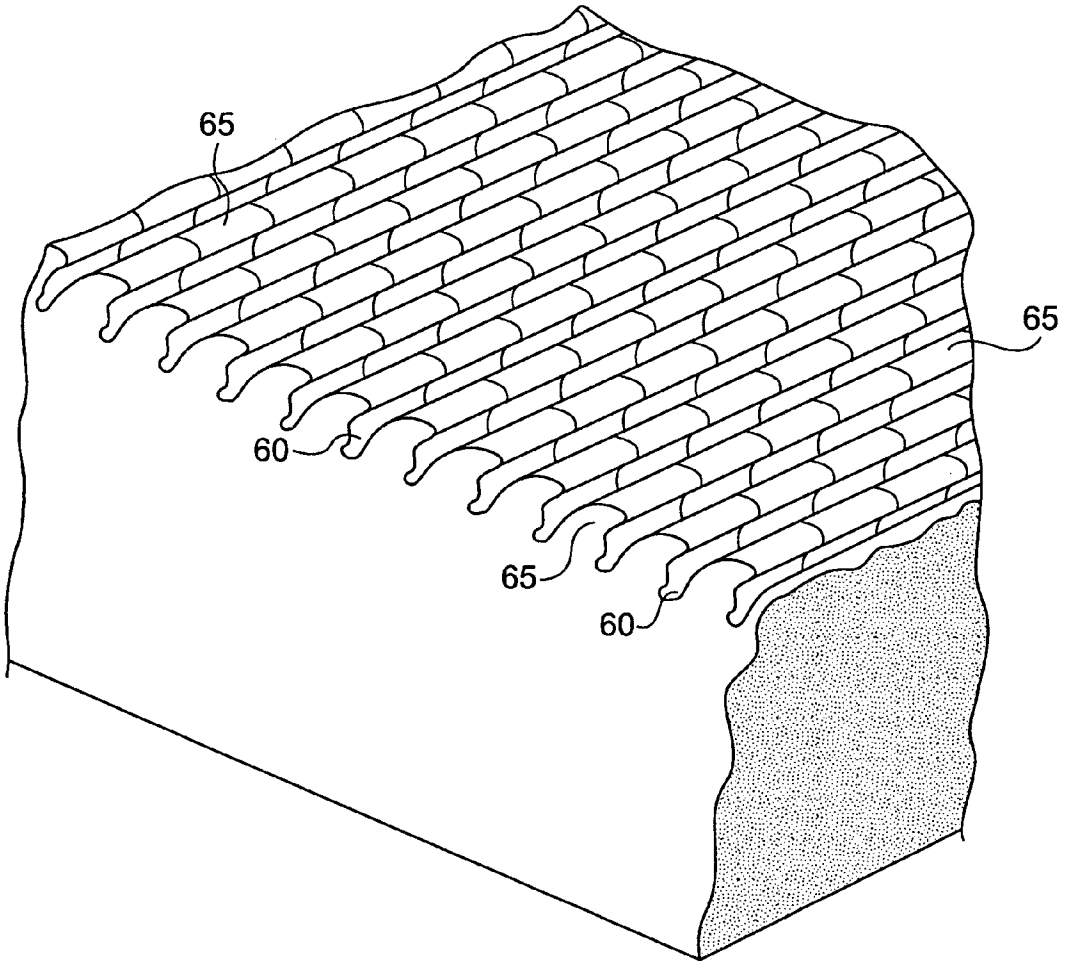
FIG. 5 is a first enlarged partial perspective view of a mattress according to the present invention.
Figure 6:
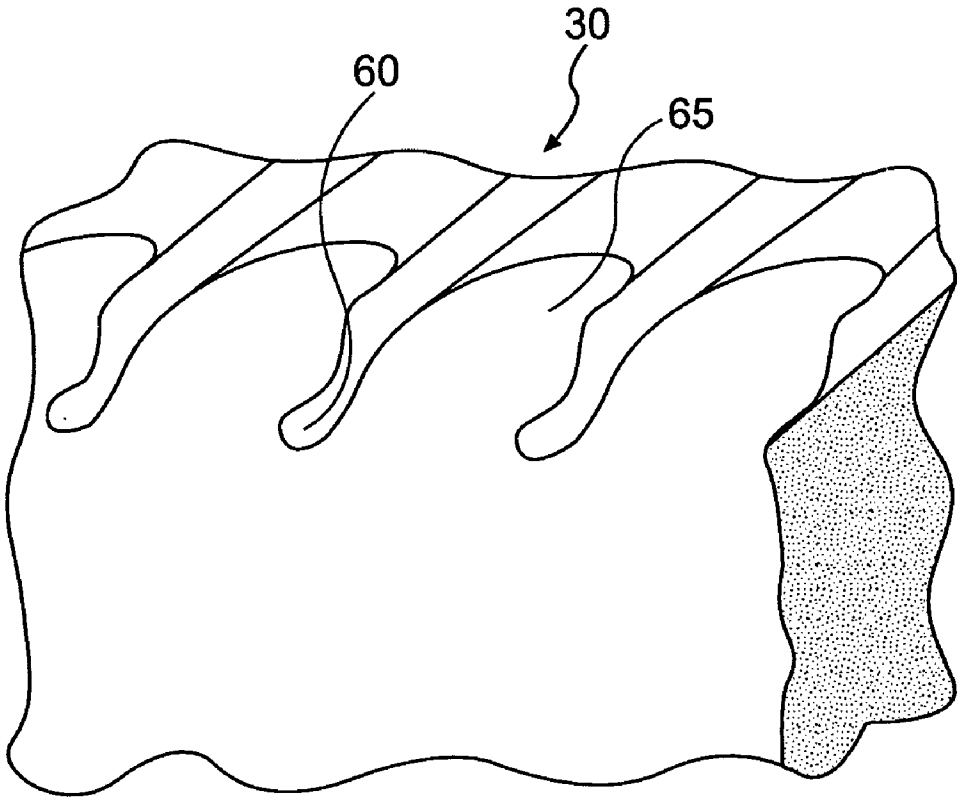
FIG. 6 is a second enlarged partial perspective view of a section of a mattress according to the present invention.

As illustrated in FIG. 4, the directional support ribs 65 are formed by selective removal of the resilient material so as to create channels 60 in the remaining material. Such selective removal of such resilient material may be accomplished by slicing, CNC machining, milling, and the like.

Figure 7A:
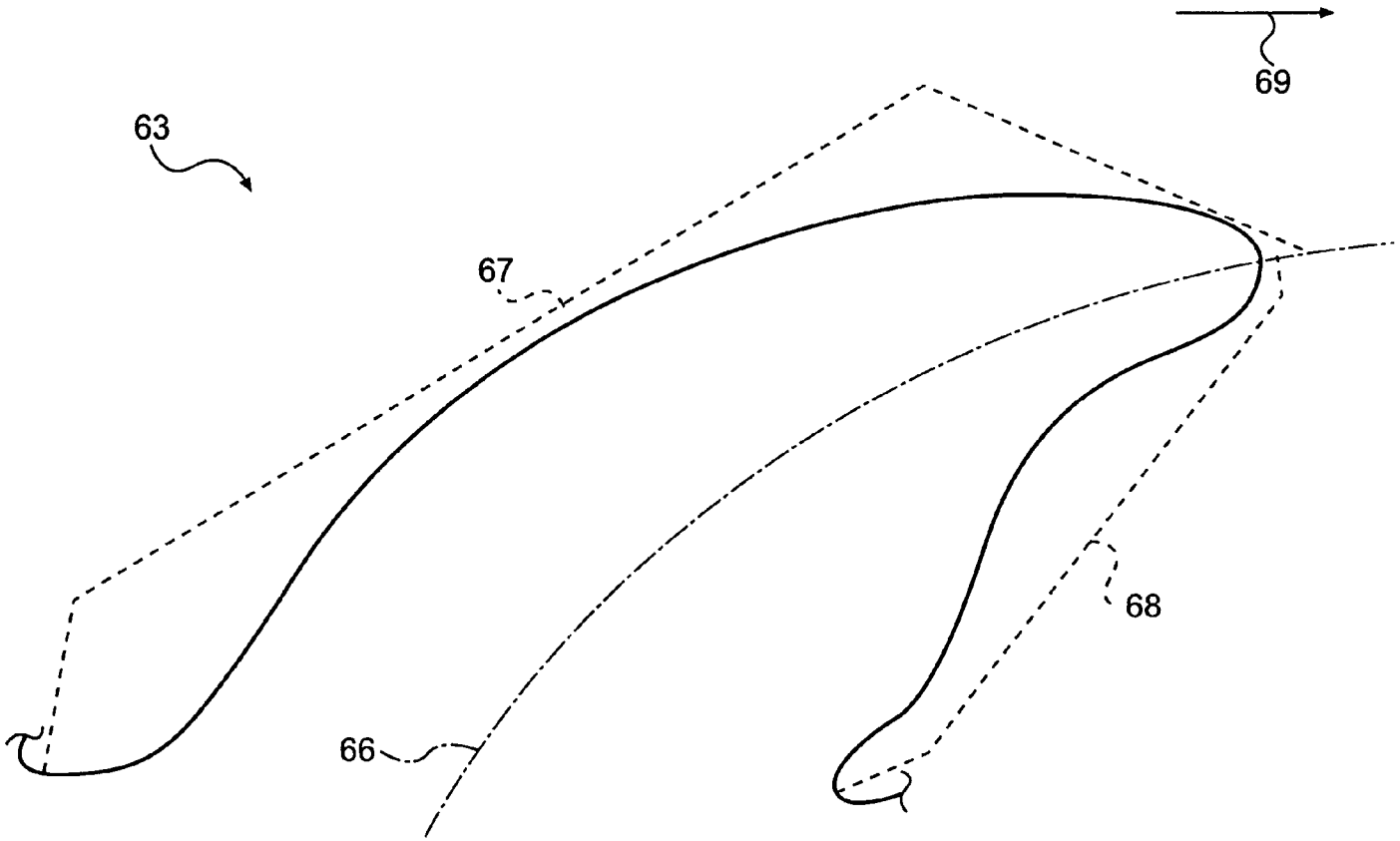
FIG. 7A is a sketch of a first exemplary cross-section of a support rib according to the present invention.
Figure 7B:
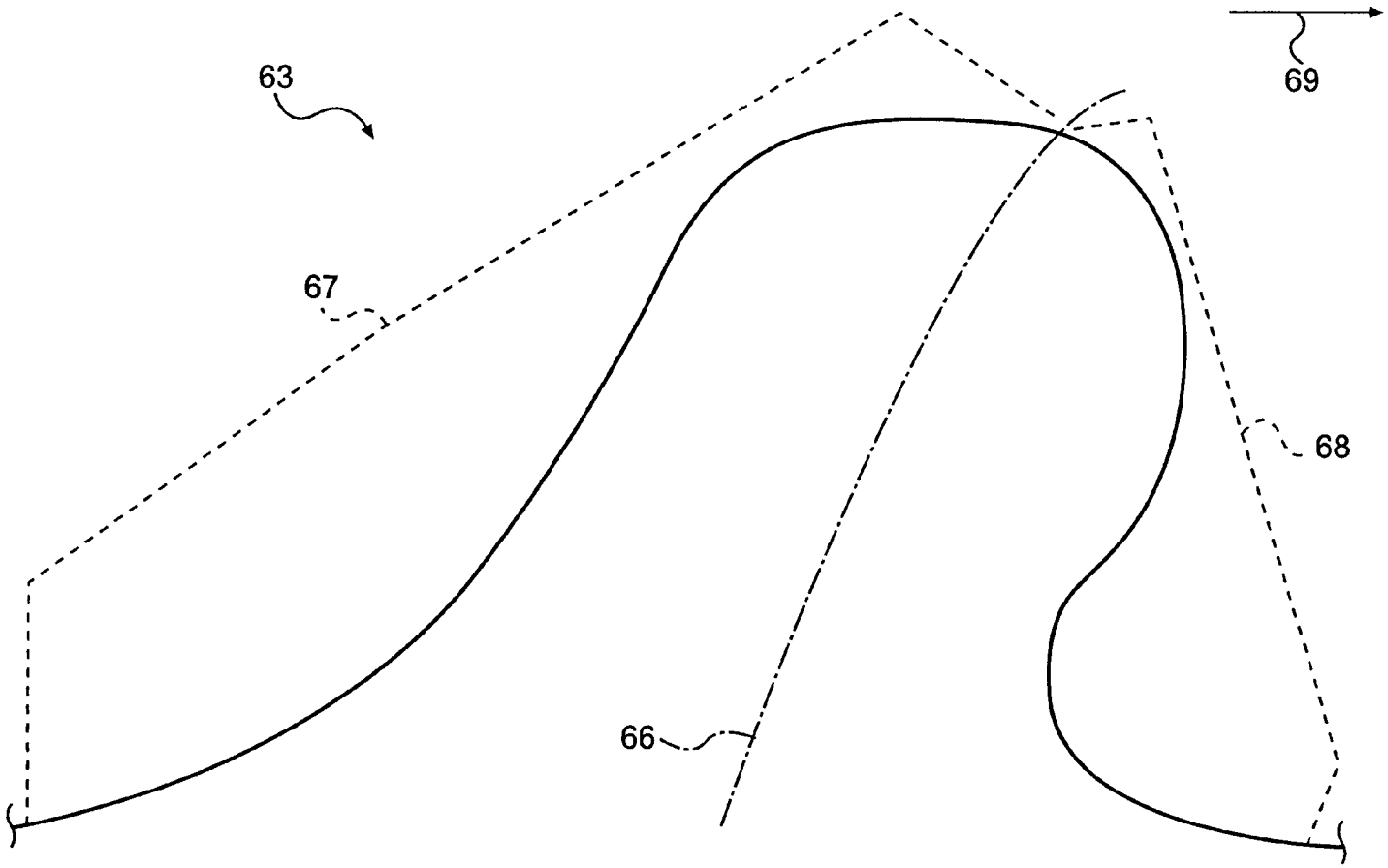
FIG. 7B is a sketch of a second exemplary cross-section of a support rib according to the present invention.
Figure 7C:
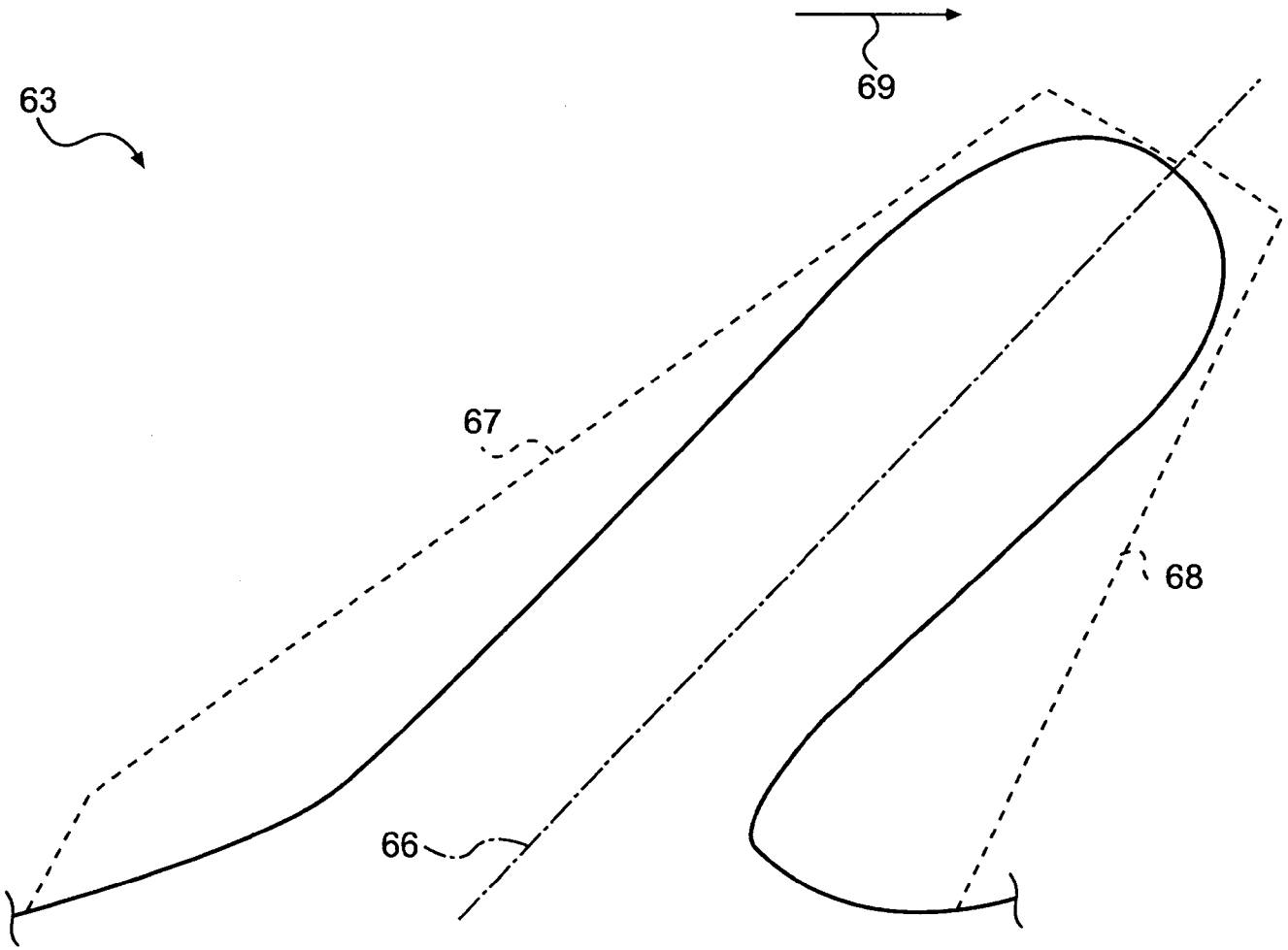
FIG. 7C is a sketch of a third exemplary cross-section of a support rib according to the present invention.

The directional support ribs 65 are configured to a predetermined cross-sectional geometry 63. Specifically, the directional support ribs 65 define a cross-sectional geometry 63 that is curvilinear—formed, bounded, or characterized by curved lines. With reference to FIGS. 7A–7C, the curvilinear cross-section geometry 63 of the directional support ribs 65 may be understood to provide a superior aspect 67 and an inferior aspect 68. FIGS. 7A–7C show two dashed lines for illustration purposes only, to demonstrate the location of the superior aspect 67 and the inferior aspect 68, along with the center line 66 of the directional support rib 65. As will be observed from FIGS. 7A–7C, the superior aspect 67 of the directional support rib 65 is defined to constitute that portion of the exposed surface of the directional support rib 65 that may receive of a portion of the body of a user of the mattress 20. By comparison, the inferior aspect 68 of the directional support rib 65 may be understood to constitute that portion of the exposed surface of the directional support rib 65 that is unavailable or not disposed for receipt of any portion of the body of a person thereon. The superior aspect 67 and the inferior aspect 68 meet generally at the center line 66 of the directional support rib 65. It may be further understood that the center line 66 of directional support ribs 65 will lie at an acute angle to the horizontal plane, and may be thereby defined to have a directional orientation 69. Directional orientation 69 is perpendicular to the axis of the body of directional support rib 65 and parallel to the longitudinal orientation of the mattress 20.

The dimensions of the channels 60 may be varied. The dimensions of the channels 60 may be varied between different channels upon the mattress 20, for advantageous reasons, or may be uniform for each channel upon a given mattress 20.

The dimensions and cross-sectional configuration of the directional support rib 65 likewise may be varied. As shown in FIG. 7A, the length of the superior aspect 67 may greatly exceed the length of the inferior aspect 68. Alternatively, as shown in FIG. 7B, the length of the superior aspect 67 may only slightly exceed the length of the inferior aspect 68, but nevertheless provide a directional orientation 69 to the directional support rib 65. Moreover, the distance between adjacent channels 60 on either side of the directional support rib 65 may be varied, as illustrated by comparison between FIG. 7A and FIG. 7C. In FIG. 7A, the distance between adjacent channels 60 on either side of the directional support rib 65 may be relatively large, or as shown in FIG. 7C may be relatively small.

As will be appreciated from review of the Figures, the channel 60 may undercut a side of the directional support rib 65, such that a portion of the channel 60 lies vertically beneath a portion of the directional support rib 65. So configured, the directional support rib 65, made of a resilient material, will tend to be less resistant of movement of a person thereon in the direction of the directional orientation 69, and less receptive to movement by a person disposed thereon opposite of the directional orientation 69, in that the directional support rib 65 has less resilient material on its side favoring the directional orientation 69 and has more resilient material on the side against the directional orientation 69.

Mattress 20 may include along the entirety of its upper support surface 30 the directional support ribs 65. Alternatively, the directional support ribs 65 may be located only upon a portion of the upper support surface 30 (not shown).

The directional support ribs 65 may have a given directional orientation 69 in certain areas of the upper support surface 30 and an opposite directional orientation 69 in other areas upon upper support surface 30. Consider FIGS. 2 and 4. As shown therein, the directional orientation 69 of the directional support ribs 65 in the area of the upper support surface 30 adapted for receipt of the upper torso of a person may have a directional orientation 69 toward the foot 50 of the mattress 20. At the same time, the directional orientation 69 of the directional support rib 65 located upon the upper support surface 30 adapted for receipt of the thigh region of a person disposed thereon may have a directional orientation 69 toward the head 45 of the mattress 20. In such configuration, when the mattress 20 is inclined such as is shown in FIG. 3, a person reclined upon the mattress 20 would suffer less shear stress in the upper torso and gluteal regions, notwithstanding gravitational forces against the body downward along the inclined upper support surface 30, because of the directional orientation of the support ribs toward the foot 50 of the bed. Nevertheless, in such an orientation, sliding by the person down toward the foot 50 of the bed would be resisted by the directional orientation 69 of the directional support rib 65 toward the head 45 of the bed in the thigh region of the body, at which the tendency to develop decubitus ulcers may be less. In FIG. 4, first channel artifact 61 and second channel artifact 62 are shown to remain on the mattress 20 as a result of transitions from directional orientation 69 in a given direction to directional orientation 69 in the opposite direction.

The mattress 20 may have all of its directional support ribs residing on a single plane (not shown). Alternatively, the upper support surface 30 may comprise a plurality of separate planes. For example, as illustrated in FIG. 4, the mattress 20 may include a first plane 70 disposed toward the head 45 of the mattress 20, adapted for receipt of the upper torso of a person reclined thereon. The mattress 20 may also include a second plane 75 intersecting with the first plane 70, disposed for receipt of the gluteal region of a person reclined thereon. Still further, the mattress 20 may include a third plane 80, intersecting with the second plane 75, disposed for receipt of the thigh region of a person disposed thereon. Finally, the mattress 20 may include a fourth plane 85, intersecting with the third plane 80, adapted for receipt of the lower leg and foot region of a person reclined thereon. Configured with such plurality of planes, the mattress 20 may be readily adapted for more complete contact along the length of the body of a person reclined thereon with as much of the upper support surface 30 of the mattress 20 as possible. Consequently, localized pressure between the person's skin and the mattress is more readily dispersed and lessened. Furthermore, should the head 45 of the mattress 20 be inclined, shear stress between any given portion of the body of a person reclined thereon and the upper support surface 30 of the mattress 20 is thereby lessened.

Figure 8:
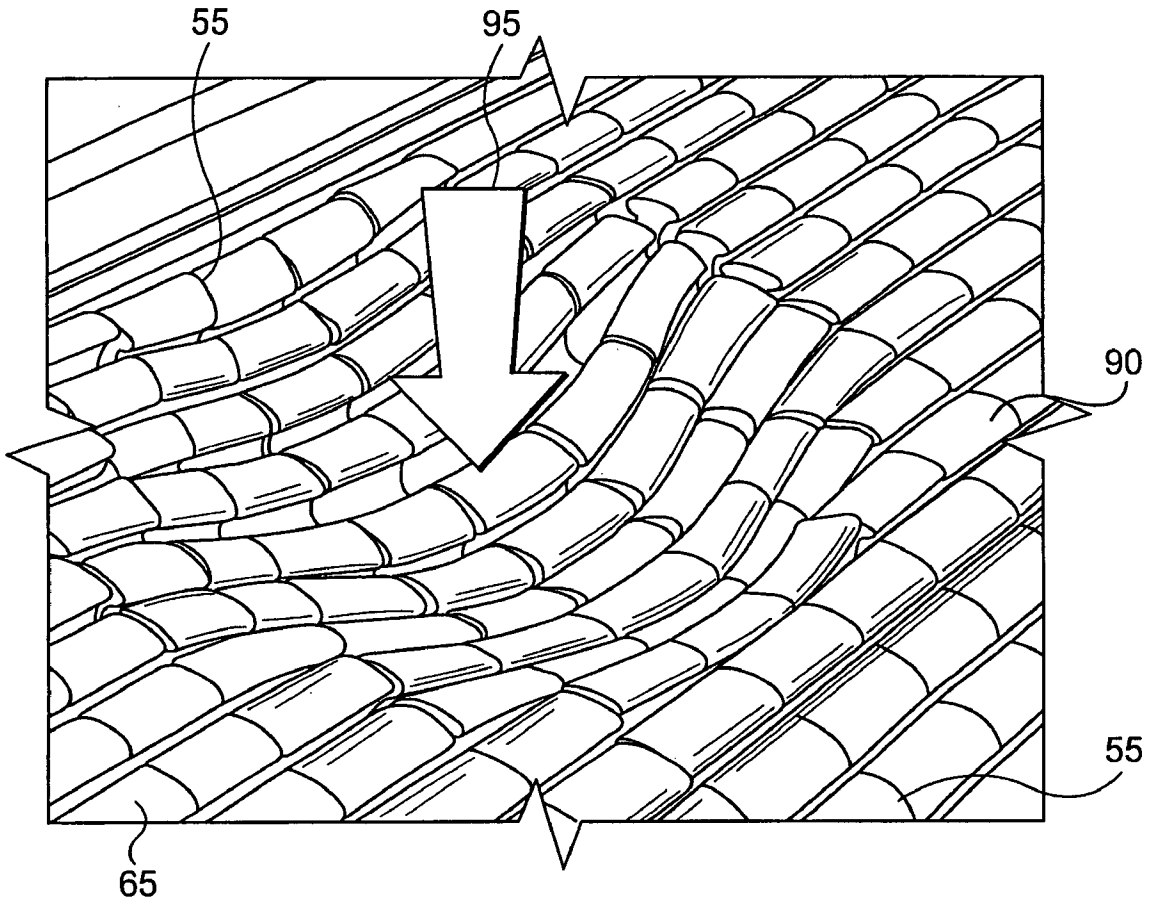
FIG. 8 is an operational illustration of a portion of the support surface of a mattress according to the present invention.

The upper surface 30 of the mattress 20 may also include longitudinal cuts 55. Such longitudinal cuts 55 may cooperate with the channels 60 to form individual cells 90 upon the upper support surface 30. Such longitudinal cuts 55 may be spaced equally one from another, or may be advantageously differently spaced (not shown), such that the cells 90 would have different widths laterally across the upper support surface 30 so as to provide differing support characteristics to differently-sized cells 90 at different regions about the upper support surface 30. With reference to FIG. 8, it will be understood that provision of such longitudinal cuts 55 to create individual cells 90 allows for more independent pressure dispersion by the cells 90 in response, for example, to gravitational forces such as depicted by force vector 95.

Various modifications and variations can be made in the embodiments of the present invention without departing from the scope and spirit of the invention. It is intended that the present invention include such modifications and variations as come within the scope of this disclosure and their equivalents.

What is claimed is:

1. A patient support mattress, comprising:

a main body of resilient material, said main body having a head end and an opposed foot end and defining a length between;

an upper support surface defined by said main body, for receipt of a person reclined thereon;

said upper support surface including a plurality of directional support ribs disposed transverse to said length;

each said directional support rib defining a cross-sectional geometry, said cross-sectional geometry including a superior aspect disposed generally for contact with a person upon said mattress, said superior aspect curvilinear;

each said directional support rib resiliently biased toward a said end of said mattress, said bias defining a directional orientation.

2. The patient support mattress of claim 1, wherein said mattress includes a thigh support zone disposed for support of the thighs of a person reclined upon said mattress, said thigh support zone including a plurality of said directional support ribs having directional orientation toward said head end of said mattress.

3. The patient support mattress of claim 1, further comprising an upper torso support zone disposed for support of the upper torso on a person reclined upon said mattress, a gluteal support zone disposed for support of the gluteal region of a person reclined upon said mattress, a thigh support zone disposed for support of the thighs of a person reclined upon said mattress, and a lower leg support zone disposed for support of the lower legs of a person reclined upon said mattress.

4. The patient support mattress of claim 3, wherein said thigh support zone includes a plurality of said directional support ribs having directional orientation toward said head end of said mattress, and wherein said upper torso support zone and said gluteal support zone and said lower leg support zone include a plurality of said directional support ribs having a directional orientation toward said foot end of said mattress.

5. The patient support mattress of claim 3, wherein each said support zone is generally planar, each said support zone converging with an adjacent said support zone.

6. The patient support mattress of claim 4, wherein each said support zone is generally planar, each said support zone converging with an adjacent said support zone.

7. The patient support mattress of claim 6, said mattress bendable generally between said gluteal support zone and said thigh support zone, to allow elevation of said head end of said mattress.

8. The patient support mattress of claim 1, further comprising a plurality of cuts formed in said upper support surface along said length.

9. The patient support mattress of claim 5, further comprising a plurality of cuts formed in said upper support surface along said length.

10. The patient support mattress of claim 6, further comprising a plurality of cuts formed, in said upper support surface along said length.

11. A patient support mattress, comprising:

a main body of resilient material, said main body having a head end and an opposed foot end and defining a length between;

an upper support surface defined by said main body, for receipt of a person reclined thereon;

said upper support surface including a plurality of support zones along said length, each said support zone converging with an adjacent said support zone;

said upper support surface including a plurality of directional support ribs disposed transverse to said length within at least one said support zones;

each said directional support rib defining a cross-sectional geometry, said cross-sectional geometry including a superior aspect and an opposed inferior aspect, said superior aspect longer than said inferior aspect, said superior aspect disposed for receipt of a person reclined upon said mattress, said superior curvilinear, each said directional support rib defining a directional orientation from said superior aspect to said inferior aspect, each said directional support rib resiliently biased in said directional orientation.

12. The patient support mattress of claim 11, wherein said support zones include an upper torso support zone disposed for support of the upper torso on a person reclined upon said mattress, a gluteal support zone disposed for support of the gluteal region of a person reclined upon said mattress, a thigh support zone disposed for support of the thighs of a person reclined upon said mattress, and a lower leg support zone disposed for support of the lower legs of a person reclined upon said mattress.

13. The patient support mattress of claim 11, wherein said mattress includes a thigh support zone disposed for support of the thighs of a person reclined upon said mattress, said thigh support zone including a plurality of said directional support ribs having directional orientation toward said head end of said mattress.

14. The patient support mattress of claim 12, wherein said thigh support zone includes a plurality of said directional support ribs having directional orientation toward said head end of said mattress.

15. The patient support mattress of claim 12, wherein said thigh support zone includes a plurality of said directional support ribs having directional orientation toward said head end of said mattress, and wherein said upper torso support zone and said gluteal support zone and said lower leg support zone include a plurality of said directional support ribs having a directional orientation toward said foot end of said mattress.

16. The patient support mattress of claim 12, said mattress bendable generally between said gluteal support zone and said thigh support zone, to allow elevation of said head end of said mattress.

17. The patient support mattress of claim 11, further comprising a plurality of cuts formed in said upper support surface along said length.

18. The patient support mattress of claim 17, wherein said cuts are spaced equally one from another.

19. The patient support mattress of claim 17, wherein said cuts are spaced one from another by predetermined differing distances.

20. A patient support mattress, comprising:

a main body of resilient material, said main body having a head end and an opposed foot end and defining a length between;

an upper support surface defined by said main body, for receipt of a person reclined thereon;

said upper support surface including a plurality of support zones along said length, each said support zone generally planar, each said support zone intersecting with an adjacent said support zone;

said upper support surface including a plurality of directional support ribs disposed transverse to said length within at least one said support zones;

each said directional support rib defining a curvilinear cross-sectional geometry including a centerline disposed at an acute angle to said at least one said support zone, said acute angle defining a directional orientation of said directional support rib.

21. The patient support mattress of claim 20, wherein said support zones include an upper torso support zone disposed for support of the upper torso on a person reclined upon said mattress, a gluteal support zone disposed for support of the gluteal region of a person reclined upon said mattress, a thigh support zone disposed for support of the thighs of a person reclined upon said mattress, and a lower leg support zone disposed for support of the lower legs of a person reclined upon said mattress.

22. The patient support mattress of claim 20, wherein said mattress includes a thigh support zone disposed for support of the thighs of a person reclined upon said mattress, said thigh support zone including a plurality of said directional support ribs having directional orientation toward said head end of said mattress.

23. The patient support mattress of claim 21, wherein thigh support zone includes a plurality of said directional support ribs having directional orientation toward said head end of said mattress.

24. The patient support mattress of claim 21, wherein said thigh support zone includes a plurality of said directional support ribs having directional orientation toward said head end of said mattress, and wherein said upper torso support zone and said gluteal support zone and said lower leg support zone include a plurality of said directional support ribs having a directional orientation toward said foot end of said mattress.

25. The patient support mattress of claim 20, further comprising a plurality of cuts formed in said upper support surface along said length.

26. The patient support mattress of claim 25, wherein said cuts are spaced equally one from another.

27. The patient support mattress of claim 25, wherein said cuts are spaced one from another by predetermined differing distances.

* * * * *